United States Patent [19]

Huang

[11] Patent Number: 4,903,452

[45] **Date of Patent: * Feb. 27, 1990**

[54] MODULAR SPACE FRAMED EARTHQUAKE RESISTANT STRUCTURE

[76] Inventor: Yen T. Huang, 9405 Pinewood Dr., Dallas, Tex. 75243

[ * ] Notice: The portion of the term of this patent subsequent to Mar. 21, 2006 has been disclaimed.

[21] Appl. No.: 197,818

[22] Filed: May 23, 1988

Related U.S. Application Data

[63] Continuation-in-part of Ser. No. 124,832, Nov. 24, 1987, Pat. No. 4,831,191.

[51] Int. Cl.[4] ..... E04H 12/18

[52] U.S. Cl. ..... 52/646; 52/648; 52/637; 52/236.6

[58] Field of Search ..... 52/236.6, 637, 638, 52/646, 653, 649

[56] References Cited

U.S. PATENT DOCUMENTS

| | | | |
|---|---|---|---|
| 1,090,312 | 5/1914 | Lachman | 52/653 |
| 2,383,163 | 8/1945 | Roten | 52/637 |
| 2,782,379 | 5/1961 | Fisher | 52/638 |
| 2,959,256 | 11/1960 | Deam | 52/236.1 |
| 3,347,000 | 10/1967 | Smith | 52/236.1 |
| 3,407,559 | 10/1968 | Durand | 52/637 |
| 3,999,351 | 12/1976 | Rensch | 52/280 |
| 4,288,947 | 9/1981 | Huang | 52/81 |
| 4,480,414 | 11/1984 | Tschudy | 52/236.1 |

FOREIGN PATENT DOCUMENTS

| | | | |
|---|---|---|---|
| 2306318 | 10/1976 | France | 52/637 |

*Primary Examiner*—Henry E. Raduazo
*Attorney, Agent, or Firm*—W. Kirk McCord

[57] ABSTRACT

A modular space framed structure is constructed using uniform components to provide the desired geometry of the modular structure. The structure is comprised of a plurality of rigid Y-shaped joints, each of which has three branches which are disposed at respective predetermined space angles with respect to one another, and a plurality of panels spanning the spaces between the joints. In one embodiment the space angle between first and second branches are approximately 120° and the respective space angles between a third branch and each of the first and second branches are approximately 90° so that the interconnection of first and second branches of adjacent devices defines a hexagonal frame at each level in the structure and the interconnection of aligned ones of the third branches defines vertical legs of the structure. A plurality of such structures may be arranged to form a honeycomb shaped building construction with common vertical legs between adjacent structures. The Y-shaped joints may be comprised of three tubular branches or alternatively, three C-channel beams.

6 Claims, 11 Drawing Sheets

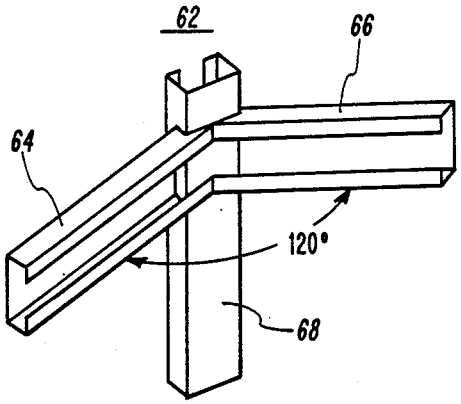
FIG. 12a
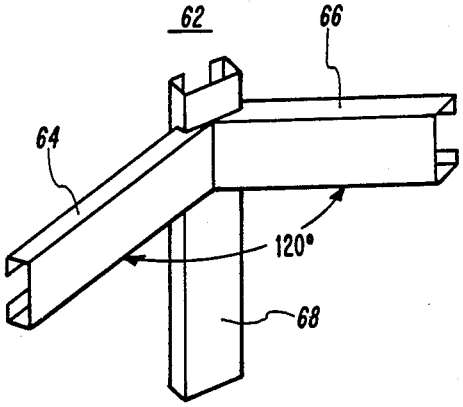
FIG. 12b
FIG. 12c
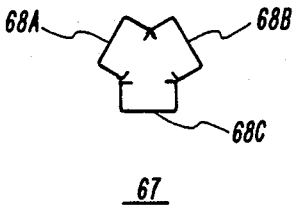
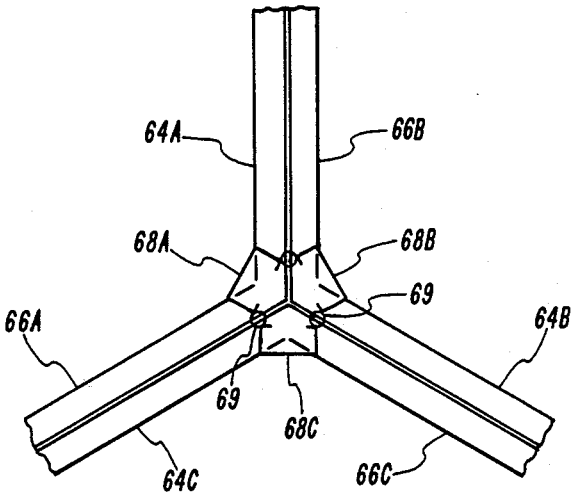
FIG. 12d

MODULAR SPACE FRAMED EARTHQUAKE RESISTANT STRUCTURE

This is a continuation-in-part of co-pending patent application serial number 124,832, filed Nov. 24, 1987, now U.S. Pat. No. 4,831,191.

FIELD OF THE INVENTION

The present invention relates generally to modular space framed structures and in particular to a modular space framed support structure for enhancing the earthquake resistance of the building structure being constructed.

BACKGROUND OF THE INVENTION

Constructions, such as buildings, offshore platforms and the like, typically include a substructure, such as a foundation, support beams or the like, to support the superstructure of the construction. In building construction structural frames can support loadings acting in unison with the foundation system. In the case of an offshore platform, the support structure, which is typically comprised of vertical support members embedded in the ocean bottom, is substantially completely disposed below the ocean surface for supporting the platform superstructure above the water level.

DESCRIPTION OF THE PRIOR ART

According to prior practice the support structure for an offshore platform is typically comprised of vertical support members (e.g., "jack up" platform) which are embedded at one end at respective first ends thereof in the ocean bottom with concrete anchoring blocks or the like and respective second ends which are in contact with the platform superstructure to maintain the superstructure above the water line. Laterally extending cross-members are typically used to provide structural rigidity for the support structure. The support structure typically has a rectangular cross-section so that the width of the support structure is substantially the same from top to bottom along the support structure.

One problem associated with such rectangular support structures is that the stability of the support structures diminishes as a function of the vertical depth thereof for a given width of the support structure. The stability problem is particularly significant if the offshore platform is located in an area of high earthquake probability. The horizontal movement of the seabed caused by an earthquake will produce an overturning moment on the platform. The magnitude of the overturning moment is directly proportional to the force of the earthquake and the height of the platform above the seabed (i.e., the depth of the water) and is indirectly proportional to the horizontal width or diameter, as the case may be, of the support structure. In deep water, the width of the support structure must be substantially increased, which not only complicates the construction process, but also substantially increases the cost thereof.

Another problem associated with a rectangular frame structure is the diminished horizontal force resistive capability because of the square corners and the turbulent air flow around the corners of the structure. These limitations apply irrespective of whether the structure is located onshore or offshore.

OBJECTS OF THE INVENTION

It is, therefore, the principal object of the present invention to provide an improved building structure.

It is another object of the invention to enhance the resistance of the support structure to earthquake forces.

It is still another object of the invention to provide a modular support structure which can be constructed by interconnecting uniform structural components.

It is still another object of the invention to provide a modular support structure using relatively lightweight uniform components which can be structurally reinforced on site.

It is a further object of the invention to provide uniform structural components, which can be manufactured in a factory with rigid quality control of each component, thereby reducing the amount of work necessary in the field.

It is still a further object of the invention to reduce the time and cost of constructing building structures.

SUMMARY OF THE INVENTION

These and other objects are accomplished in accordance with the present invention wherein a modular construction device is comprised of first, second and third beams which are interconnected to define a rigid Y-shaped joint with respective space angles between each pair of beams. The first and second beams are adapted to define respective portions of respective first and second horizontal frame members at a particular level of a multilevel space framed structure. The third beam is adapted to define a corresponding portion of a leg of the structure interconnecting the particular level of the structure with an adjacent level therein. The first and second beams intersect a third beam at a selected position between first and second opposite ends of the third beam.

In one aspect of the invention the first and second beams are notched adjacent to their respective intersections with the third beam for receiving a portion of the third beam within the notch so that at least a portion of the third beam projects from the notch in each direction along a major axis of the third beam. In one embodiment the first, second and third beams are comprised of respective first, second and third C-channel beams, each of which has a base member and a pair of lip flanges projecting from the base member.

In another aspect of the invention a building construction is comprised of a plurality of multi-level structures, each of which is in turn comprised of a plurality of sets of modular construction devices corresponding to the number of levels of the corresponding structure. The construction devices of each set have first, second and third beams of substantially equal length with a space angle of approximately 120 degrees between the first and second beams to define a substantially hexagonal frame at each level of each structure. The space angles between the third beam and each of the first and second beams of each construction device are approximately 90 degrees to define substantially vertical legs on each structure.

First connection means is provided for interconnecting the first and second beams of the construction devices of each set so that the first and second beams define a polygonal frame at a corresponding level of the corresponding structure. Second connector means is provided for interconnecting aligned ones of the third beams at successive levels in the corresponding structure to define corresponding legs of the corresponding structure.

Selected portions of the polygonal frame at each level of each structure are substantially in abutting relationship with corresponding portions of the respective polygonal frames of respective adjacent structures. Selected ones of the third beams of each structure are substantially in abutting relationship with corresponding ones of selected third beams of adjacent structures at respective corners of the adjacent structures. The abutting third beams are joined together to define corresponding common vertical legs of the building construction.

BRIEF DESCRIPTION OF THE DRAWINGS

Further objects and advantages of the invention will be apparent from the detailed description and claims when read in conjunction with the accompanying drawings wherein:

FIGS. **12*a*–12*d*** are perspective views of an alternative embodiment of a modular construction device according to the present invention;

FIGS. **12*c* and 12*d*** are respective top and bottom plan views of corresponding branches of the modular construction devices which are connected to define a common vertical leg of abutting structures.

Figure 11:
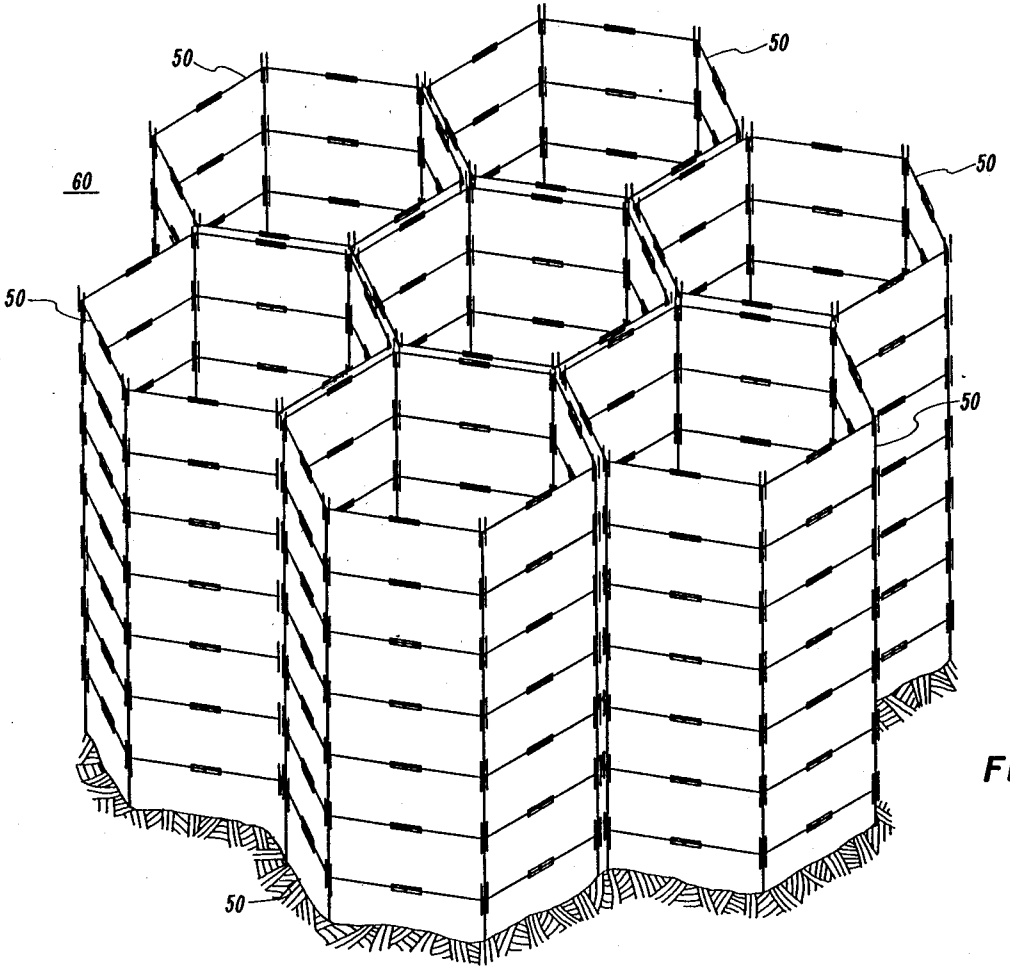
FIG. 11 is a perspective view showing the interconnection of a plurality of the structures shown in FIG. 10.
Figure 13:
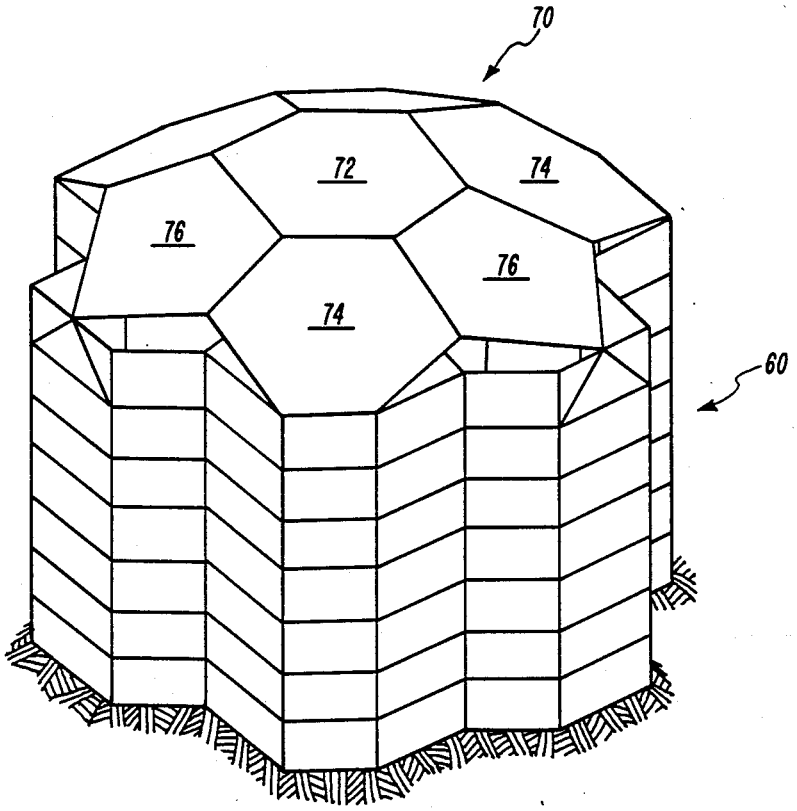
Figure 14:
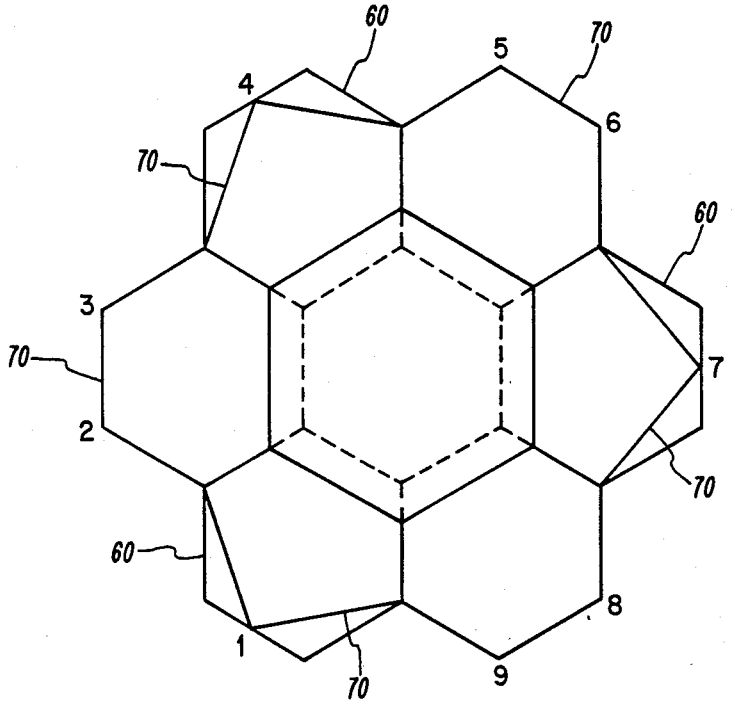
Figure 15:
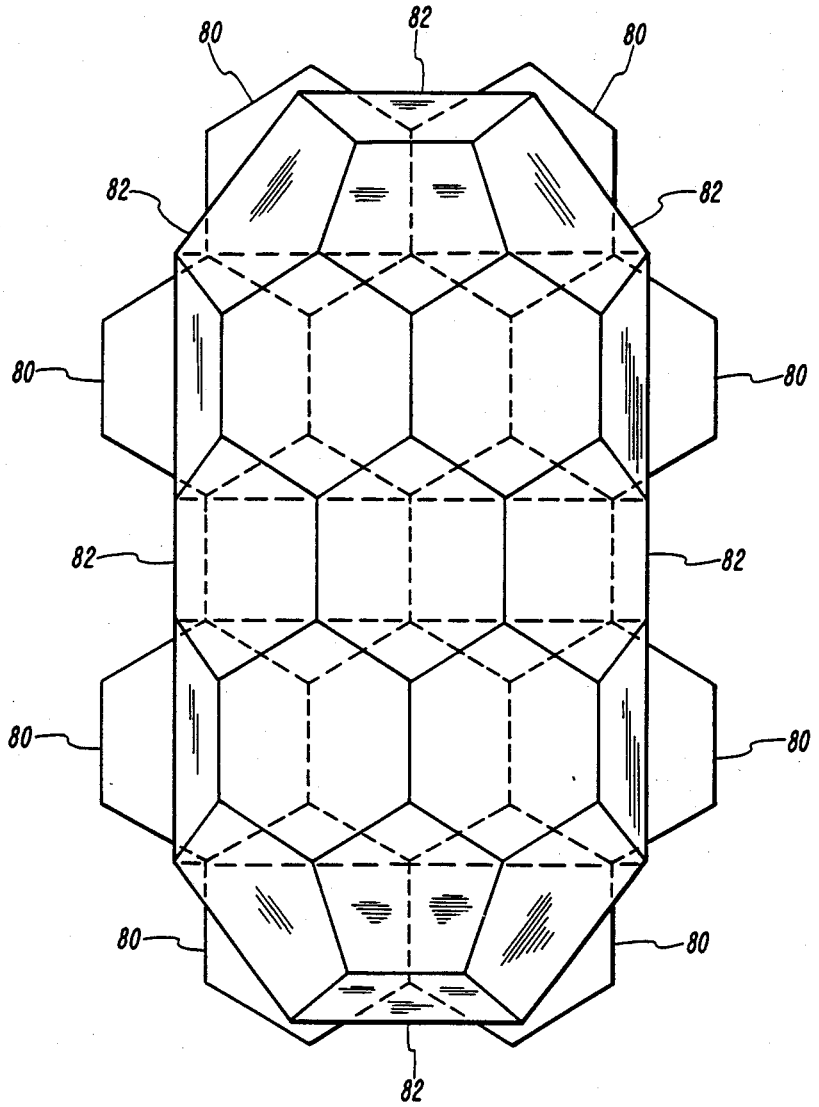
Figure 16:
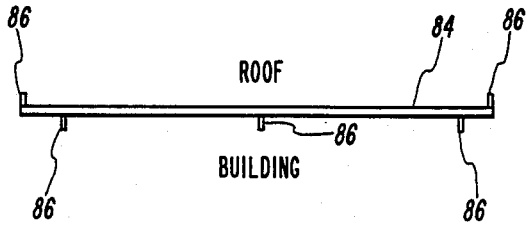

FIG. 13 is a perspective view of the structure depicted in FIG. 11 with an inflatable self-supporting dome roof connected thereto;

FIG. 14 is a top plan view of the structure depicted in FIG. 13;

FIG. 15 is a top plan view of a modular space framed structure with a substantially rectangular roof connected thereto;

FIG. 16 is an elevational view of an adapter for connecting the rectangular roof to the structure shown in FIG. 15; and FIG. **17*a* and 17*b*** are perspective views of a wrap around sleeve used to connect abutting tubular branches comprising the frame members in a multi-structure building construction.

DETAILED DESCRIPTION OF THE PREFERRED EMBODIMENT

In the description which follows, like parts are marked throughout the specification and drawings, respectively. The drawings are not necessarily to scale and in some instance proportions have been exaggerated in order to more clearly depict certain features of the invention.

Figure 1:
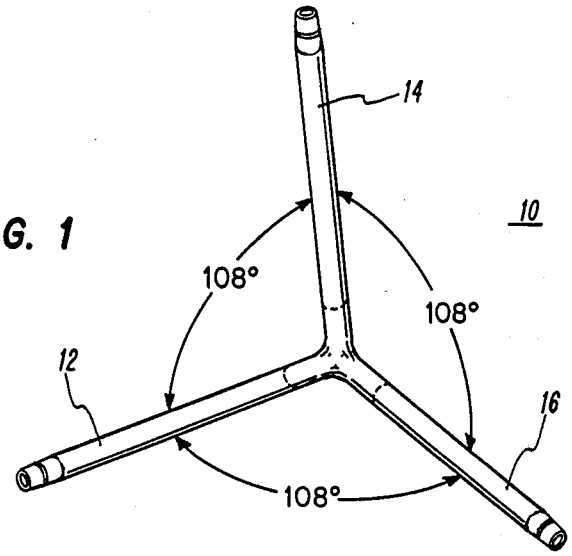
FIG. 1 is a perspective view of a modular construction device according to the present invention.

Referring to FIG. 1, a modular construction device 10 is comprised of first, second and third tubular branches 12, 14 and 16 of equal length, which are interconnected to define a rigid Y-shape joint with respective obtuse space angles between each pair of tubular branches. In the embodiment illustrated in FIG. 1, the three space angles are each 108°.

Figure 3:
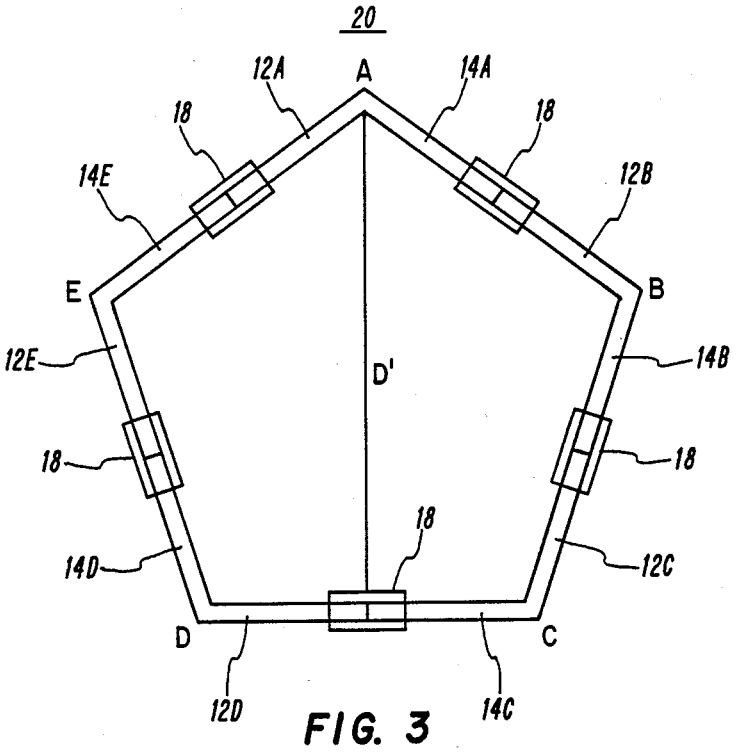
FIG. 3 is a top plan view of a particular level in the modular space framed structure.
Figure 4A:
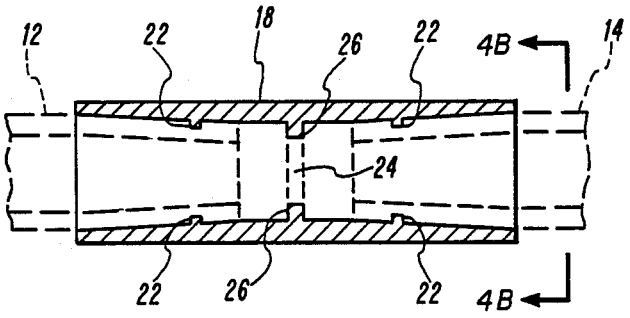
FIGS. 4A and 4B are respective sectional and end views of a sleeve member used to interconnect aligned tubular members at a particular level in the modular space framed structure.

Referring also to FIG. 3, a plurality of construction devices 10 are interconnected by a corresponding plurality of sleeve members 18 to define a pentagonal-shaped horizontal frame 20. In FIG. 3, five construction devices 10 are connected at the respective five corners A, B, C, D, and E of pentagonal frame 20 so that the corresponding third tubular branch 16 of each device 10 depends outwardly and downwardly from the plane defined by frame 20 and the corresponding first and second tubular branches 12 and 14 are interconnected to define corresponding members of frame 20. For example, first tubular branch 12E of the particular device 10 disposed at corner E of frame 20 is aligned with the corresponding second tubular branch 14D of the particular device 10 which is disposed at corner D of frame 20. Each sleeve member 18 has a central bore extending therethrough for receiving respective facing ends of each pair of aligned tubular branches, as best illustrated in FIG. 4A. Each sleeve member 18 connects the corresponding first tubular branch 12 of one device 10 with the corresponding second tubular branch 14 of an adjacent device 10 to define pentagonal frame 20. Each member of frame 20 has a length approximately twice that of the length of each tubular branch.

Figure 4B:
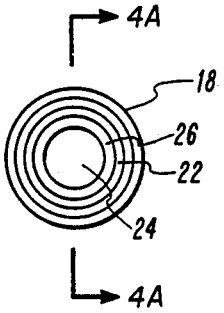

Referring also to FIGS. 4A and 4B, the ends of each tubular branch 12 and 14 are tapered for being received within the central bore of the corresponding sleeve member 18. Disposed adjacent to the end of each tubular branch 12, 14 is a groove (see FIG. 1) which extends circumferentially around the corresponding tubular branch 12, 14 for engaging a corresponding male notch 22 in the bore of sleeve member 18 for locking the corresponding tubular branches 12, 14 in respective predetermined fixed positions within sleeve member 18. A central hole 24 is left open to accommodate the passage of pre-stressing wire cables. A rigid diaphragm 26 of sleeve member 18 is sandwiched between the respective facing ends of aligned first and second tubular branches 12 and 14. The locking engagement between the corresponding female groove and male notch 22 is described in greater detail in U.S. Pat. No. 4,288,947, which is incorporated herein by reference.

Figure 5:
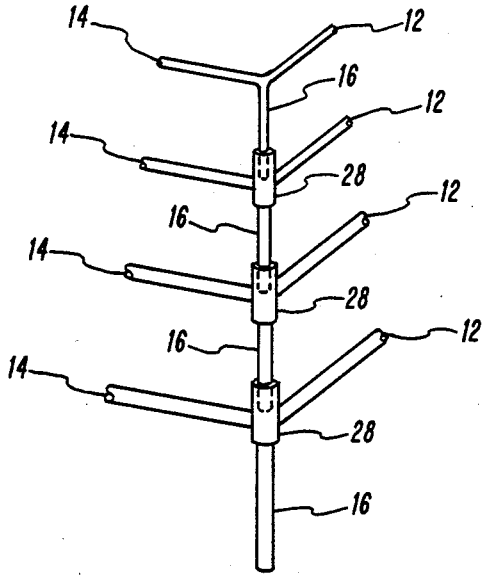
FIG. 5 is a perspective view of the interconnection of the corresponding tubular members at successive levels to define the vertical legs of the structure in accordance with the present invention.
Figure 6:
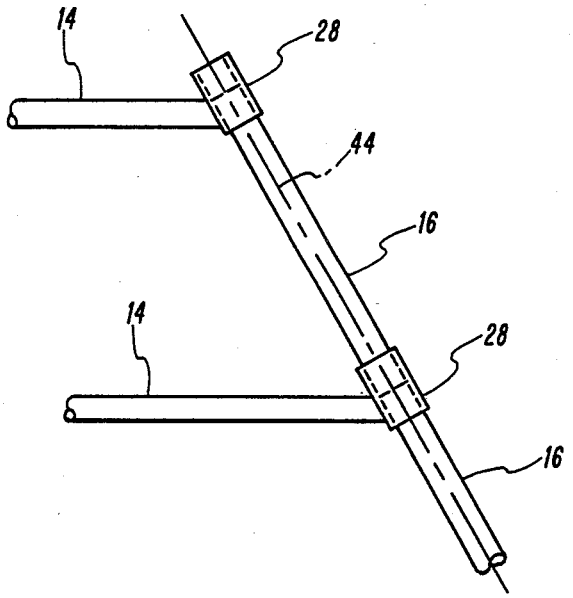
FIG. 6 is an elevational view illustrating the interconnection of the corresponding tubular members at successive levels to define the vertical legs of the structure in accordance with the present invention.

Referring to FIGS. 5 and 6, the corresponding third tubular branches 16 are interconnected by means of a corresponding plurality of sleeve members 28 to define a substantially vertical leg. Each sleeve member 28 is preferably integrally formed on a corresponding construction device 10 so that a portion of each sleeve member 28 extends beyond the intersection of first, second and third tubular branches 12, 14 and 16 of the corresponding device 10, as best shown in FIG. 6.

Figure 7A:
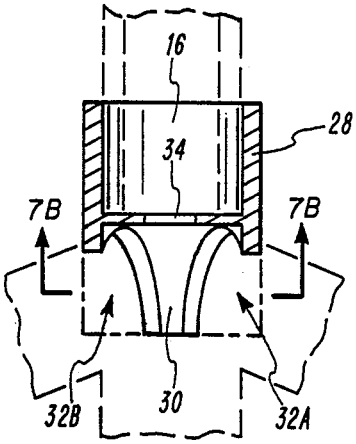
FIGS. 7A and 7B are respective sectional and end views of a sleeve member used to interconnect the corresponding tubular members at successive levels in the structure to define the vertical legs of the structure in accordance with the present invention.
Figure 7B:
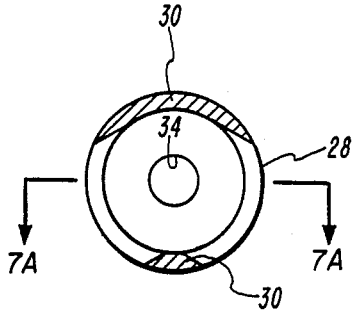

Referring to FIGS. 7A and 7B, sleeve member 28 includes a centrally disposed flexible saddle 30, which defines two chambers 32A and 32B within sleeve member 28 for receiving the corresponding first and second tubular branches 12 and 14 within sleeve member 28. Sleeve member 28 further includes a central diaphragm 34 for being sandwiched between the corresponding third tubular banch 16 of an adjacent construction device 10 and saddle 30. The locking engagement described above with reference to FIGS. 4A and 4B is also used to receive third tubular branch 16 within the corresponding sleeve member 28.

Figure 2:
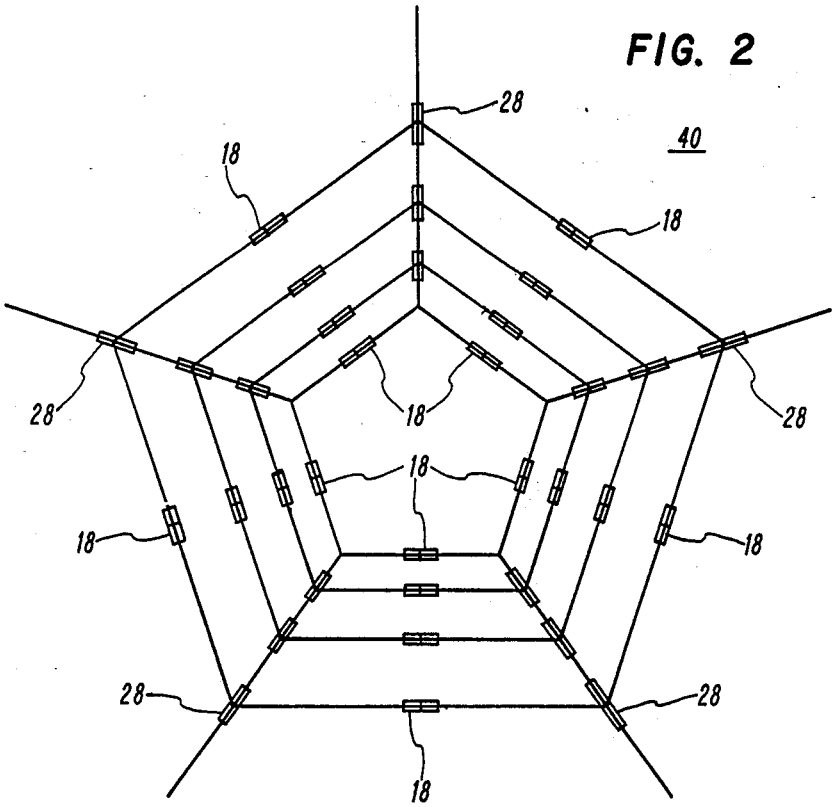
FIG. 2 is a generalized top plan view of a modular space framed structure according to the present invention.
Figure 8:
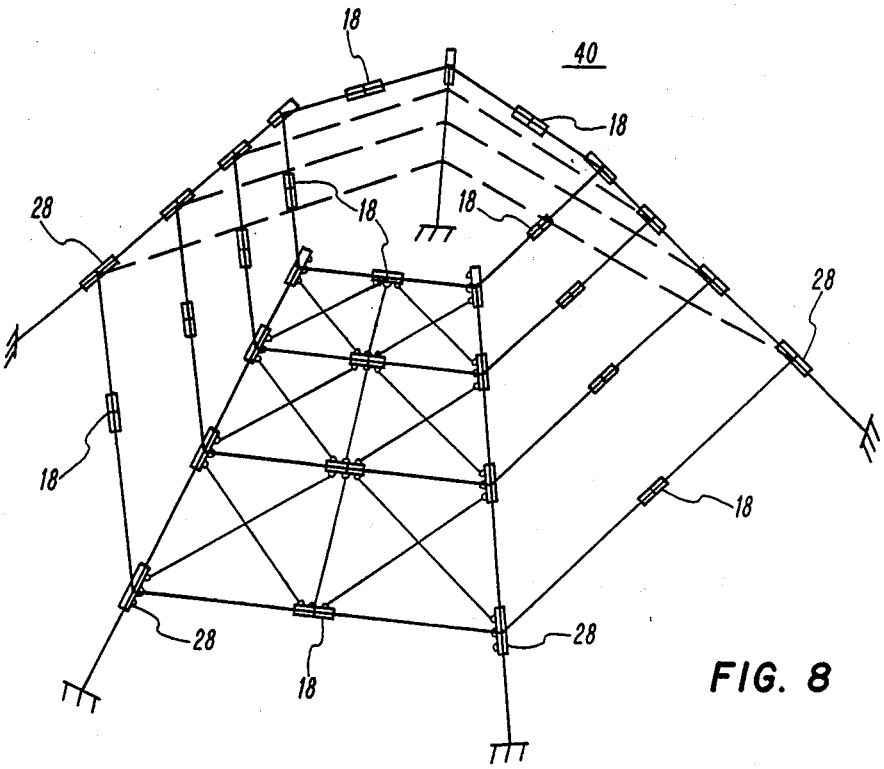
FIG. 8 is a perspective view of a modular space framed structure in accordance with the present invention.

Referring to FIGS. 2 and 8, a modular space framed structure 40 in the shape of a truncated pyramid is formed by interconnecting a plurality of construction devices 10. Construction devices 10 are divided into N number of discrete sets of construction devices 10 corresponding to N number of levels in structure 40. In FIGS. 2 and 8, structure 40 is shown with four levels, with each level being comprised of a discrete pentagonal frame 20. The vertical legs of structure 40 are inclined at a predetermined acute angle with respect to respective vertical axes which are perpendicular to the respective horizontal planes defined by the respective pentagonal frames to enhance the stability and earthquake resistance of structure 40. The pentagonal frame at the uppermost level of structure 40 has the smallest area among the frames and each successively lower pentagonal frame has a corresponding greater area. The inclined legs are defined by the interconnection of aligned third tubular branches 16 at each successive level in structure 40.

Tubular branches 12, 14 and 16 of each device 10 in each discrete set have substantially the same length. For example, if the length of each tubular branch 12, 14 and 16 in the uppermost level is L, the length of each tubular branch 12, 14 and 16 at each level in structure 40 is equal to approximately $1.309^{(N-1)} \times L$, where N is an integer representing the particular level in structure 40 counting in succession from the uppermost level to the lowermost level of structure 40. Therefore, the length of each tubular branch 12, 14 and 16 increases by approximately 30.9% between each successive level in structure 40 from the top to the bottom thereof. Similarly, the diameter D' (which is measured as shown in FIG. 3) increases by approximately 30.9% between each successive level from top to bottom in structure 40. It can be determined mathematically that the diameter D' of each pentagonal frame is equal to approximately 3.0777 multiplied by the length of each tubular branch 12, 14 and 16 (i.e., $3.0777 \times 1.309^{(N-1)} \times L$) at that particular level in structure 40. Thus, the diameter D' of the lowermost level (i.e., N=4) in structure 40 is approximately 6.9031 L as compared to the diameter D' of the uppermost level (i.e., N=1) of structure 40, which is approximately 3.0777 L.

Structure 40 can be reinforced by applying bracing members between pentagonal frames, as shown in FIG. 8, particularly in areas where seismic, ice, current, wave and wind forces acting on the structure become critical. Panels may also be used to span the spaces between the pentagonal frames. The tubular branches and sleeve members have central openings for receiving pre-stressing cables 44 therethrough, as shown in FIG. 6, to achieve structural rigidity. A filler material, such as concrete, can be poured into the tubular branches to further reinforce the structure.

Figure 9:
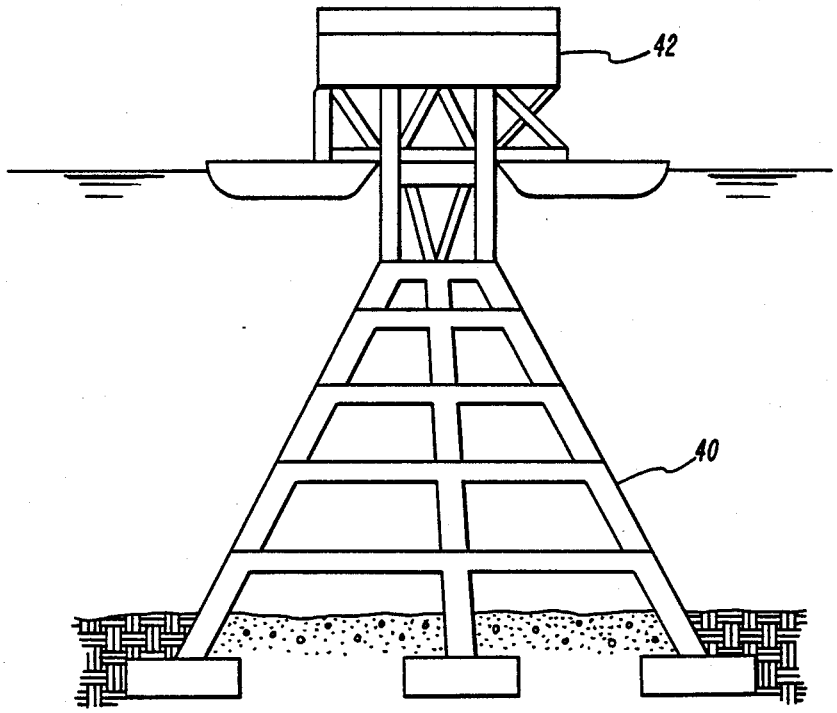
FIG. 9 is an elevational view of an earthquake resistant structure for supporting an offshore platform in accordance with the present invention.

The modular space framed structure 40 according to the present invention is particularly well-suited for marine operations where support structures must be built under adverse conditions. Referring to FIG. 9, structure 40 can be used as a submerged structure to support a work platform superstructure 42. Structure 40 can be assembled on shore and transported to the installation site or alternatively structure 40 can be assembled on site using modular devices 10.

The earthquake resistance force of a structure can be expressed as $Ph/D_b$, where P is the lateral force exerted on the structure by the earthquake, h is the height of the structure and $D_b$ is the diameter of the base level of the structure. The natural pyramidal shape of the structure according to the present invention lowers the center of gravity of the structure and substantially reduces the required earthquake resistance force of the structure by increasing the diameter of the base level thereof. For example, a substantially rectangular structure having the same diameter from top to bottom of approximately 3.0777 L will require an earthquake resistance force of approximately Ph/3.0777L. On the other hand, a pyramidal structure according to the present invention having seven levels with the same diameter D' at the uppermost level as the aforementioned rectangular structure will require an earthquake resistance force of approximately Ph/15.4833L. Thus, the earthquake resistance force is approximately one-fifth of the conventional rectangular structure with substantially the same diameter D' at the top level in the structure.

The pentagonal frames comprising each level of the structure provide an optimum balance between the horizontal force resistive capability of a circular frame structure and the ease of construction of a rectangular frame structure. Another advantage of the modular space frame structure according to the present invention is the rigidity of the corners at each level in the structure provided by rigid modular construction devices. The aligned branches of the modular construction devices can be quickly and conveniently interconnected as compared to conventional pin or bolt connections. The construction devices can be manufactured to uniform specifications in a factory with rigid quality control, thereby reducing the amount of work necessary in the field.

An added advantage of the rigid Y-shape construction devices lies in the minimization of underwater welded construction. It is well known that in off-shore platform construction, field welding creates problems of Localized Brittle Zone (LBZ) and Heat Affected Zone (HAZ) which contribute to many structural failures and loss of the expensive off-shore platforms. A similar advantage applies to on-shore constructions.

Figure 10:
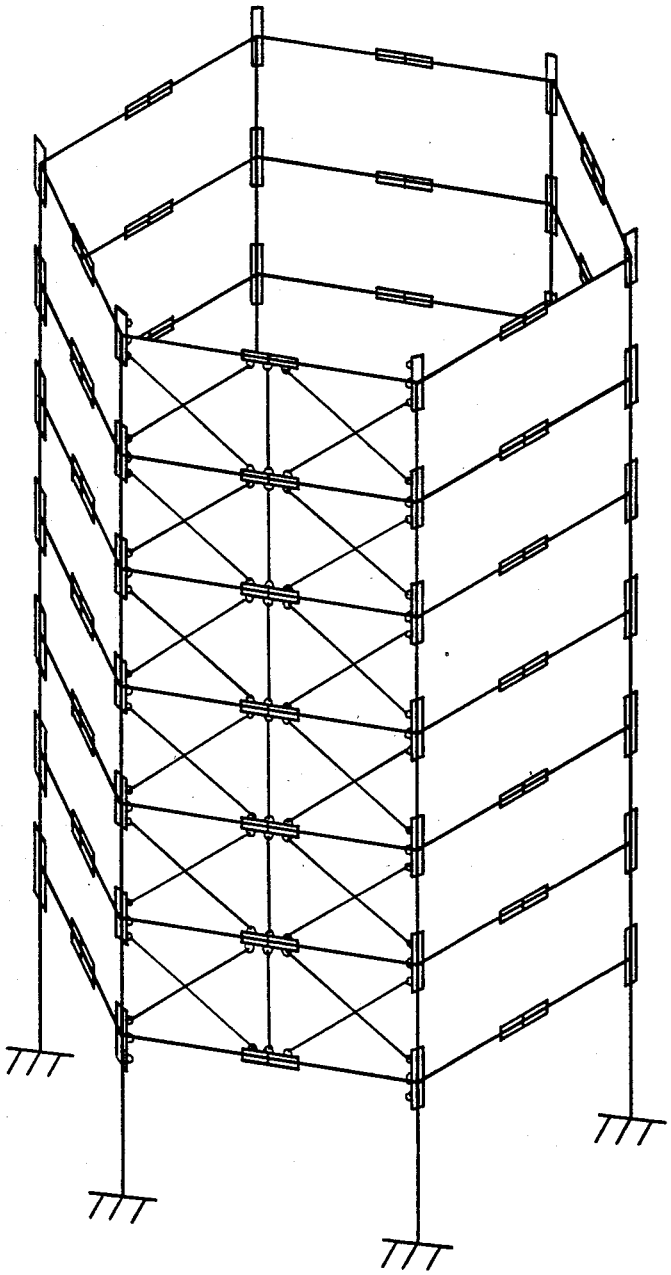
FIG. 10 is a perspective view of a modular space framed structure in accordance with the present invention having a hexagonal lateral cross section.

Referring to FIG. 10, a modular space framed structure 50 is comprised of vertical legs and hexagonal space frames at each level in structure 50 to achieve a vertical walled tower structure 50. Structure 50 is constructed in substantially the same manner as described above with reference to FIGS. 1-9, except that the tubular branches of the modular construction devices are disposed at respective space angles of 120°, 90°, and 90° to define a tower with a hexagonal lateral cross section and vertical legs instead of the 108°, 108° and 108° space angles described above with reference to FIG. 8. Structure 50 is well-suited for onshore tower construction.

Figure 17A:
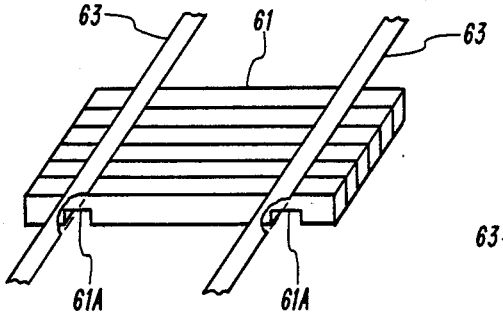
Figure 17B:
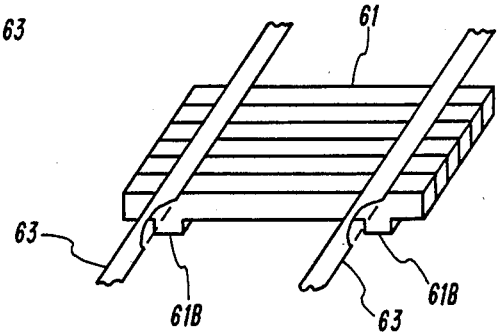

Referring to FIG. 11, a plurality of vertical walled towers 50 can be interconnected to define a honeycomb-shaped structure 60 by connecting individual towers 50 along their abutting frame members with cable or the like, to substantially enhance the earthquake resistance of the entire structure 60. A wrap around sleeve 61, as shown in FIGS. 17*a* and 17*b*, may be placed around the abutting tubular branches of adjoining towers 50 to interconnect the adjoining towers 50 and also to connect the tubular branches of each tower end to end to form the individual members of each hexagonal frame. Wrap around sleeve 61 may be used in lieu of cylindrical sleeve member 18, described above with reference to FIGS. 1–9. The wrap around sleeve is preferably tightened by steel bands 63 around the outside of the sleeve 61. Sleeve 61 may include female grooves 61A for mating with complementary male members on the abutting tubular branches around which sleeve 61 is wrapped, or alternatively, male notches 61B for mating with complementary female members on the abutting tubular branches.

Referring to FIGS. 12*a*–12*d*, a modular construction device 62, comprised of three C-channel beams 64, 66 and 68, may be used in lieu of device 10 with its tubular branches 12, 14 and 16 to form each tower 50 and structure 60. Beams 64, 66 and 68 are of substantially equal length and are interconnected to define a rigid Y-shaped joint with respective space angles therebetween. In the embodiment illustrated, the space angle between first and second beams 64 and 66 is 120° and the respective space angles between third beam 68 and each of first and second beams 64 and 66 are approximately 90°. Beams 64, 66 and 68 may be manufactured as an integral unit or, alternatively, first and second beams 64 and 66 may be integrally formed with a notch cut out at the intersection between the two beams to allow the two beams to fit over third beam 68 and be attached thereto by welding or the like. First and second beams 64 and 66 are attached to third beam 68 at a position between respective opposite ends of third beam 68 so that respective portions of third beam 68 project from the notched area in both directions along the axis of third beam 68. First and second beams 64 and 66 may be disposed with their respective channels facing inwardly, as in FIG. 12*a*, or facing outwardly, as in FIG. 12*b*. In this manner first and second beams 64 and 66 define respective portions of the horizontal frame members at the corresponding level in the structure and third beam 68 defines a portion of a corresponding vertical leg of the structure.

Another aspect of the invention is illustrated in FIGS. 12*c* and 12*d*. Honeycomb structure 60 may have common vertical legs between adjacent towers 50. A common vertical leg is formed by interconnecting a plurality of leg members 67 end to end. Each leg member 67 is comprised of three beams 68, which are preferably welded together along their respective adjacent lip flanges to define three attachment faces 68A, 68B and 68C on leg member 67, as best seen in FIG. 12*c*. Three corresponding pairs of horizontal beams 64A and 66A, 64B and 66B and 64C and 66C are attached to corresponding attachment faces 68A, 68B and 68C, respectively, with adjacent beams in abutting relationship, as best shown in FIG. 12*d* to define a corresponding corner of structure 60. Welding rods 69 extend at least partially upward along the three beams 68 from the respective bottom ends of beams 68, between adjacent lip flanges. Rods 69 provide a slight separation between beams 68 so that the bottom portion (as seen in FIG. 12*d*) of the three beams 68 is wider than the top portion (as seen in FIG. 12*c*). This disparity in width allows the corresponding top portion of one leg member 67 to be received inside of the corresponding bottom portion of another leg member 67 to form the common vertical legs of structure 60. Leg members 67 may be secured together by welding.

Abutting pairs of beams 64 and 66 are preferably attached together and are interconnected end-to-end with other abutting beam pairs to define the horizontal frame members at each level in structure 60 by means of gusset plates (not shown) or the like, which are bolted to the respective faces of the beams. The gusset plates span the end-to-end connections between abutting beam pairs to interconnect the beam pairs between the respective corners of structure 60. One skilled in the art will appreciate that the gusset plates perform an analogous function to sleeve members 18, described above with reference to FIGS. 1–9. Structure 60 may be prestressed by passing wire cables through the enclosed channels formed by the abutting beams.

Referring to FIG. 13, honeycomb structure 60 is adapted for receiving a modular inflatable dome structure of the type described and claimed in U.S. Pat. Nos. 4,288,947 and 4,583,330, both of which are incorporated by reference herein. Dome structure 70 is preferably comprised of an hexagonal apex 72 with alternating hexagonal and pentagonal panels 74 and 76, respectively, connecting apex 72 with the uppermost level of structure 60. A special adapter sleeve (not shown) or the like will normally be used to effect the connection between dome structure 70 and the uppermost level of structure 60. FIG. 14 illustrates nine different points of connection 1–9 at which inflatable dome structure 70 is attached to the corresponding frame members at the uppermost level of structure 60.

Referring to FIGS. 15 and 16, five additional tower structures 50 are added to the seven tower structures 50 comprising honeycomb structure 60 shown in FIG. 11 to define a twelve tower honeycomb structure 80. A substantially rectangular roof structure 82 may be used to cover honeycomb structure 80, as shown in FIG. 15. FIG. 16 illustrates an adapter 84 with a plurality of sleeve members 86 projecting upwardly and downwardly therefrom for connecting roof 82 to structure 82 below. Both dome roof 70 and rectangular roof 82 are sloped from their respective apexes to the points of connection of the respective roof structures to the building structure beneath to enhance drainage from the roof. The curvature of the roof structure and the curved corners provided by the hexagonal frames of the tower structures divert the winds acting on the structure and reduce the effects of wind forces. The interconnection between the individual tower structures along their common vertical legs and at selected positions on the abutting horizontal frame members serves to strengthen the entire structure against wind and seismic forces.

Various embodiments of the invention have been described in detail. Since it is obvious that many changes in and additions to the above-described preferred embodiment may be made without departing from the nature, spirit and scope of the invention, the invention is not to be limited to said details except as set forth in the appended claims.

What is claimed is:

1. A modular construction device comprising first, second and third beams which are interconnected to define a rigid Y-shaped joint with respective space angles between each pair of beams, said first and second beams being adapted to define respective portions of respective first and second horizontal frame members at a particular level of a multi-level space framed structure, said third beam being adapted to define a corresponding portion of a leg of the structure interconnecting said particular level with an adjacent level, said first and second beams intersecting said third beam at a selected position between first and second opposite ends of said third beam, said first and second beams being notched adjacent to their respective intersections with said third beam for receiving a portion of the third beam within the notch so that at least a portion of the third beam projects from the notch in each direction along a major axis of the third beam.

2. The device according to claim 1 wherein said first, second and third beams are comprised of respective first, second and third C-channel beams, each of which has a base member and a pair of lip flanges projecting from the base member.

3. The device according to claim 1 wherein said third beam is adapted for being positioned in abutting relationship with at least one corresponding third beam of another construction device to define a common leg of a building construction comprised of a plurality of multilevel structures, said abutting third beams for providing respective attachment surfaces for the corresponding first and second beams to define the respective corners of the adjacent structures.

4. A building construction, comprising:

a plurality of multi-level structures, each of which is comprised of:

a plurality of sets of modular construction devices corresponding to the number of levels of the corresponding structure, the construction devices of each set having first, second and third branches of substantially equal length and interconnected to define a rigid Y-shape with a space angle of approximately 120° to define a substantially hexagonal frame at each level of each structure and the space angles between the third branch and each of the first and second branches of each construction device are approximately 90° to define substantially vertical legs on each structure, said first, second and third branches of each construction device being comprised of respective first, second and third beams, said first and second beams intersecting said third beam at a selected position between first and second opposite ends of said third beam;

first connector means for interconnecting the corresponding first and second beams of the construction devices of each set so that the first and second beams of the construction devices of each set define a polygonal frame at a corresponding level of the corresponding structure; and second connector means for interconnecting aligned ones of the third beams at successive levels in the corresponding structure to define the corresponding legs of the corresponding structure;

selected portions of the polygonal frame at each level of each structure being substantially in abutting relationship with corresponding portions of the respective polygonal frames of respective adjacent structures, selected ones of the third beams of each structure being substantially in abutting relationship with corresponding ones of selected third beams of adjacent structures at respective corners of the adjacent structures, said abutting third beams being joined together to define corresponding common vertical legs of the building construction.

5. The building construction according to claim 4 wherein said first, second and third beams are comprised of respective first, second and third C-channel beams, each of which has a base member and a pair of lip flanges projecting from the base member, said abutting third means being joined together along at least, a portion of their respective lip flanges so that the respective base members of the abutting beams provide respective attachment surfaces for the corresponding first and second beams.

6. The building construction according to claim 4 wherein said first and second beams of each construction device are notched adjacent to their respective intersections with said third beam for receiving the corresponding third beam within the notch so that at least a portion of the corresponding third beam projects from the notch in each direction along the axis of the corresponding third beam.

* * * * *